US009193567B2

(12) United States Patent
Peacock et al.

(10) Patent No.: US 9,193,567 B2
(45) Date of Patent: Nov. 24, 2015

(54) METHOD IN THE MANUFACTURE OF AN ELEVATOR

(75) Inventors: Mark Peacock, Riihimäki (FI); Zhizhong Yan, Espoo (FI); Matti Eskelinen, Hyvinkää (FI); Johannes De Jong, Järvenpää (FI)

(73) Assignee: KONE CORPORATION, Helsinki (FI)

( * ) Notice: Subject to any disclaimer, the term of this patent is extended or adjusted under 35 U.S.C. 154(b) by 531 days.

(21) Appl. No.: 13/453,603

(22) Filed: Apr. 23, 2012

(65) Prior Publication Data

US 2012/0272612 A1 Nov. 1, 2012

Related U.S. Application Data

(63) Continuation of application No. PCT/FI2010/050835, filed on Oct. 22, 2010.

(30) Foreign Application Priority Data

Oct. 23, 2009 (FI) ..... 20090389

(51) Int. Cl.
*B66B 19/00* (2006.01)
*B66B 11/00* (2006.01)

(52) U.S. Cl.
CPC ..... *B66B 19/00* (2013.01); *B66B 11/00* (2013.01); *B66B 11/0045* (2013.01); *Y10T 29/49826* (2015.01); *Y10T 29/49828* (2015.01)

(58) Field of Classification Search
CPC ..... B66B 19/00; B66B 19/005; B66B 11/00; B66B 11/0045
USPC ..... 187/414, 900; 52/741.1, 745.17, 745.2; 29/418, 423, 429, 525.01
See application file for complete search history.

(56) References Cited

U.S. PATENT DOCUMENTS 3,519,101 A 7/1970 Sieffert
5,000,292 A * 3/1991 Chapelain et al. ..... 187/408
6,805,222 B2 * 10/2004 St. Pierre et al. ..... 187/254
(Continued)

FOREIGN PATENT DOCUMENTS

FR 2694279 A1 2/1994
JP 54108331 A 8/1979
(Continued)

OTHER PUBLICATIONS

Formal translation, JP 03 264482 A, FLS, Inc., Aug. 2012, pp. 1-13.*
(Continued)

*Primary Examiner* — Emmanuel M Marcelo
*Assistant Examiner* — Stefan Kruer
(74) *Attorney, Agent, or Firm* — Harness, Dickey & Pierce, P.L.C.

(57) ABSTRACT

Method in the manufacture of an elevator, in which method the parts of a platform, more particularly its support structure, are used for forming the structure that supports the machinery of the final machine room of the elevator, which platform has earlier been in its position in a position disposed lower in the elevator hoistway, and which platform was used in the aforementioned lower disposed position for supporting the machinery.

21 Claims, 4 Drawing Sheets

(56) References Cited

U.S. PATENT DOCUMENTS

Figure 1:
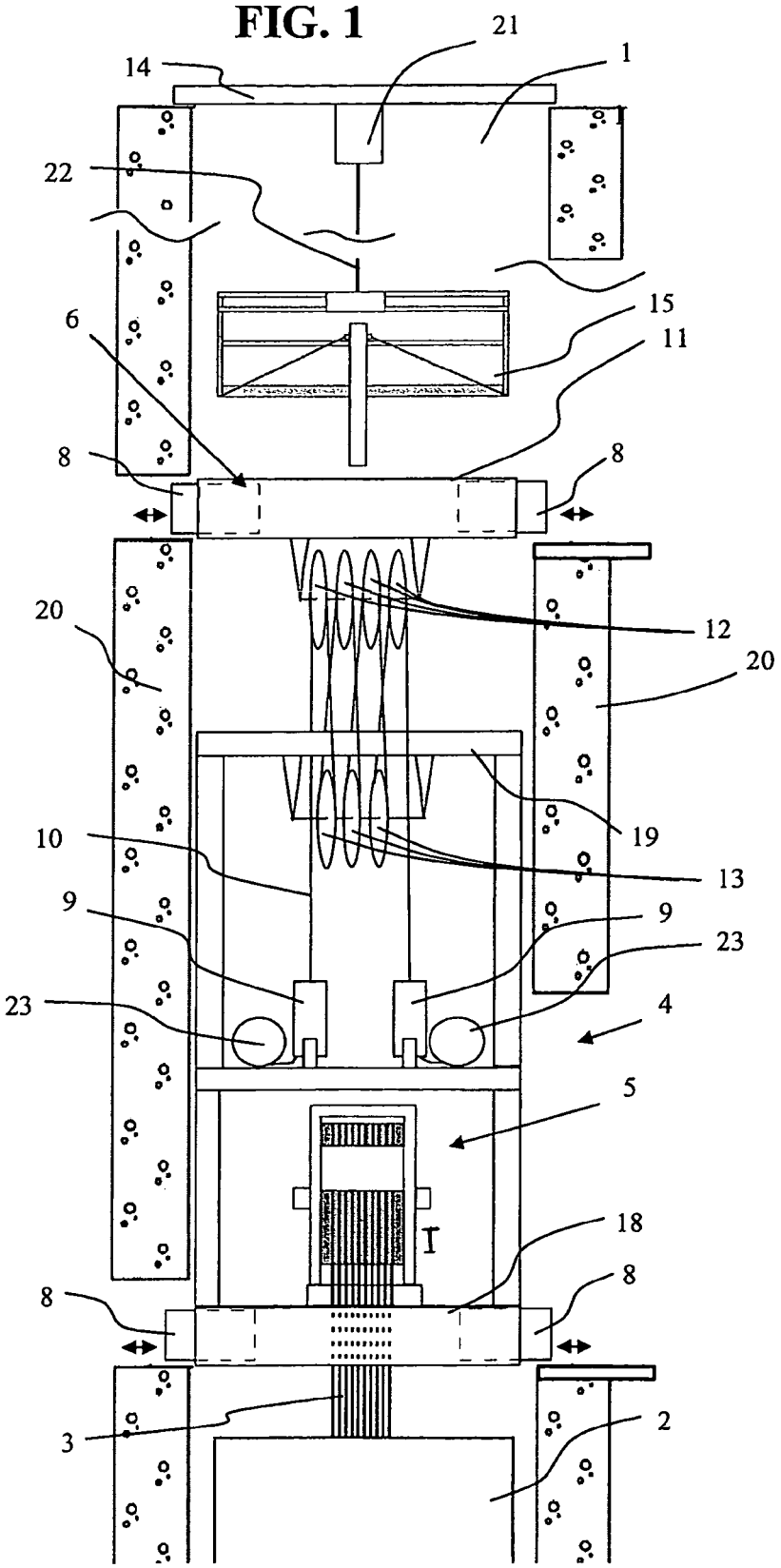

| | | | | |
|---|---|---|---|---|
| 7,624,848 | B2 * | 12/2009 | Fischer | 187/414 |
| 2007/0045207 | A1 | 3/2007 | Kollory | |
| 2007/0170014 | A1 * | 7/2007 | Woronoff | 187/414 |
| 2007/0181381 | A1 * | 8/2007 | Jungbauer et al. | 187/401 |

FOREIGN PATENT DOCUMENTS

| | | | | | |
|---|---|---|---|---|---|
| JP | 54108331 | A | * | 8/1979 | B66B 7/00 |
| JP | 3264482 | A | | 11/1991 | |
| JP | 4243786 | A | | 8/1992 | |
| JP | 05171811 | A | * | 7/1993 | E04G 21/14 |
| JP | 8133636 | A | | 5/1996 | |
| JP | 9278325 | A | | 10/1997 | |
| WO | WO-0007923 | A1 | | 2/2000 | |
| WO | WO 2004052767 | A1 | * | 6/2004 | B66B 11/04 |
| WO | WO-2006010782 | A2 | | 2/2006 | |

OTHER PUBLICATIONS

EPO Machine Translation, FR2694279A1, Jul. 19, 2012, pp. 2.*
AIPN, Machine Translation, JP 05 171 811 A, Mar. 30, 2015, pp. 1-3.*
International Search Report.

* cited by examiner

METHOD IN THE MANUFACTURE OF AN ELEVATOR

CROSS-REFERENCE TO RELATED APPLICATIONS

This application is a continuation of International Application Number PCT/FI2010/050835 filed on Oct. 22, 2010 and claims priority to Finnish Application Number FI 20090389 filed on Oct. 23, 2009, the entire contents of each of which are hereby incorporated herein by reference.

FIELD OF THE INVENTION

The object of the invention is a method in the manufacture of an elevator, which elevator is preferably an elevator applicable to passenger transport and/or to freight transport and to be installed in a building.

BACKGROUND OF THE INVENTION

In connection with so-called jump-lifts, the bottom part of an elevator hoistway is taken into use already before the building has been completed. In this case the top part of the elevator hoistway can be constructed at the same time as an elevator moving in the bottom part of the elevator hoistway already serves people on the lower floors of the building. Generally in jump-lifts the elevator car moving in the lower parts of the elevator hoistway is supported and moved during construction-time use with a hoisting machine supported on a platform in the elevator hoistway. The installation work in the parts of the elevator hoistway above this machine room platform is performed from a movable platform or corresponding in the elevator hoistway, which installation work comprises, among other things, the installation of guide rails and electrification in the elevator hoistway. When the elevator hoistway under construction above the machine room platform has reached a sufficient stage of completion, the completed part of the elevator hoistway can be taken into use. In this case a jump-lift is performed, wherein the machine room platform is raised to a higher level in the elevator hoistway. A worksite crane used in the construction of the building has conventionally been used for the lifting. One problem with this type of arrangement is that the worksite crane is not always available when needed. Another problem is that the elevator hoistway must be open at its top end so that the hook of the worksite crane that is on the roof of the building can be lowered into the hoistway. When the elevator hoistway has reached its final height, a machine room has conventionally been built at the end of the elevator hoistway and after that the final machinery of the elevator has been brought there. Thus to support the final machinery it has been necessary to construct a structure above the elevator hoistway from scratch. Another problem has been that a separate final machinery has been needed in addition to the construction-time machinery. Otherwise the final phase would have been complex and slow to perform, and the time during which the elevator is out of use would be long.

The weight of the machine room platforms combined with the weight of the parts of the elevator supported by the machine room has increased owing to, among other things, buildings that are taller than before. Owing to the very great travel heights of modern elevators, the machine size and rope masses, among other things, are so great that the hoisting capacity needed to perform the last jump-lifts is large. For the same reason, the support needed for the lifting must be robustly made. Finding advantageous support, particularly in the final phase of the manufacturing process, has been a problem, and it has been necessary to use complex solutions or a worksite crane.

AIM OF THE INVENTION

The aim of the invention is to eliminate the aforementioned drawbacks, among others, of prior-art solutions. More particularly the aim of the invention is to produce an improved method in the manufacture of an elevator. The aim of the invention is further to produce one or more of the following advantages, among others:

- A low headroom machine room is achieved.
- A safe and simple method is achieved, which method saves material and work phases in the construction of an elevator.
- Conversion of a jump-lift into the final elevator is achieved more efficiently than before.

SUMMARY OF THE INVENTION

The invention is based on the concept that the parts of the construction-time (e.g. during jump-lifts) platform, more particularly its support structure, that supports the machinery of the elevator, are used for forming the structure that supports the machinery of the final machine room of the elevator (. In this case preferably also the construction-time machinery is transferred into the space reserved for the final machine room from a position disposed lower in the elevator hoistway, while being supported by the platform that supports the construction-time machinery, more particularly by the support structure of said platform. Some advantages, among others, are the speeding up of the process because the additional need for supporting support structures in the manufacturing of the machine room decreases, the need to disassemble a temporary machine room platform decreases, and the solution brings material savings.

In one basic embodiment of the concept according to the invention, in the method in the manufacture of an elevator the parts of the platform, more particularly its support structure, are used for forming the structure that supports the machinery of the final machine room of the elevator, which platform has earlier been in its position in a position disposed lower in the elevator hoistway, and which platform was used in the aforementioned lower disposed position for supporting the machinery. Some advantages, among others, are the speeding up of the process because the additional need for supporting support structures in the manufacturing of the machine room decreases, the need to disassemble a temporary machine room platform decreases, and the solution brings material savings.

In a more refined embodiment of the concept according to the invention in the method in the manufacture of an elevator the machinery for moving the elevator car is transferred into the space reserved for the final machine room from a position disposed lower in the elevator hoistway, while being supported by the platform that supports the machinery, more particularly by the support structure of said platform, and the parts of the platform, more particularly its support structure, that supports the machinery are used for forming the structure that supports the machinery of the final machine room of the elevator. The advantages are those mentioned above.

In a more refined embodiment of the concept according to the invention, which embodiment is preferably according to one or more of the embodiments presented in the preceding, when it is in the aforementioned lower position the machinery has been in its position in the elevator hoistway supported by the platform, more particularly by the support structure of said platform, and the machinery has been used to move the elevator car below it for serving passengers. One advantage is a more efficient conversion of the jump-lift into the final elevator than before.

In a more refined embodiment of the concept according to the invention, which embodiment is preferably according to one or more of the embodiments presented in the preceding, in the method the elevator is used for serving passengers before the final travel height of the elevator is reached, and in the method a platform that supports the machinery of the elevator is moved with a plurality of jump-lifts in progressive steps upwards in the elevator hoistway, and when the platform that supports the machinery has been moved to the top part of the elevator hoistway with the aforementioned plurality of jump-lifts, the machinery of the elevator is transferred into the space that is an extension of the elevator hoistway and is reserved for the final machine room of the elevator by lifting the aforementioned platform that supports the machinery, e.g. said platform being as it is or partly disassembled. One advantage is a more efficient conversion of the jump-lift into the final elevator than before.

In a more refined embodiment of the concept according to the invention, which embodiment is preferably according to one or more of the embodiments presented in the preceding, when the machinery has been transferred into the space reserved for the final machine room, the aforementioned platform that supports the machinery is supported in its position, and the structure that supports the machinery of the final machine room of the elevator is formed at least partly from the support structure of the platform. One advantage is a more efficient conversion of the jump-lift into the final elevator than before. The method is reliable and simple. It is not necessary to form from scratch a new and separate structure capable of the supporting, but instead the old structures can be used.

In a more refined embodiment of the concept according to the invention, which embodiment is preferably according to one or more of the embodiments presented in the preceding, the support structure is lifted through from the aperture leading into the space that is an extension of the elevator hoistway and is reserved for the final machine room, after which the support structure is lowered to rest on the load-bearing structures of the building, preferably to rest on the top surfaces comprised in the load-bearing structures. One advantage is a more efficient conversion of the jump-lift into the final elevator than before. The method is reliable and simple. It is not necessary to form from scratch a new and separate structure capable of the supporting, but instead the old structures can be used. By lifting this way, the machinery supported by the support structure comprised in the platform can at the same time be lifted into the space reserved for the final machine room. Nevertheless, the machinery does not necessarily need to be lifted at the same time.

In a more refined embodiment of the concept according to the invention, which embodiment is preferably according to one or more of the embodiments presented in the preceding, and the structure that supports the machinery of the final machine room of the elevator is formed at least partly from the support structure of the aforementioned platform that supports the machinery such that the space above, and possibly also reaching to the sides of the support structure forms the space of the final machine room and the space below the support structure forms the final elevator hoistway. In this way a conventional machine room can be formed.

In a more refined embodiment of the concept according to the invention, which embodiment is preferably according to one or more of the embodiments presented in the preceding, the platform that supports the machinery comprises a support structure, which can be transferred between a contracted and (in the lateral direction) extended position, and in that the machinery is lifted while being supported by the platform into the space reserved for the final machine room by lifting the support structure through from the aperture leading into the space that is an extension of the elevator hoistway, such that the support structure is in the contracted position, after which the support structure is transferred to the extended position, in which position the support structure extends to over the load-bearing structures, and the support structure is lowered to rest on the aforementioned load-bearing structures. One advantage is a more efficient conversion of the jump-lift into the final elevator than before. The method is reliable and simple.

In a more refined embodiment of the concept according to the invention, which embodiment is preferably according to one or more of the embodiments presented in the preceding, in the extended position the support structure extends to over a load-bearing structure on at least two opposite sides of the aperture. The method is reliable and simple.

In a more refined embodiment of the concept according to the invention, which embodiment is preferably according to one or more of the embodiments presented in the preceding, after the support structure has been lowered to rest on the aforementioned load-bearing structures, casting is performed, in which casting the aperture/apertures between the elevator hoistway and the space are filled with casting material, such as with e.g. concrete-based casting material. In this way a conventional machine room can be formed, the floor of which is safe. The casting can be performed e.g. after the machinery has been transferred into the space reserved for the final machine room, if that is the procedure being followed.

In a more refined embodiment of the concept according to the invention, which embodiment is preferably according to one or more of the embodiments presented in the preceding, the casting is performed by casting the casting material onto a plate placed at the point of the aforementioned aperture/apertures, the top surface of which plate is preferably below the top surface of the floor of the space reserved for the final machine room. Thus reinforcing the structure that supports the machinery and converting said structure to be safe is simple and fast.

In a more refined embodiment of the concept according to the invention, which embodiment is preferably according to one or more of the embodiments presented in the preceding, the space reserved for the final machine room comprises a floor, on which it is possible to walk, which floor preferably comprises the aforementioned aperture O, and which space reserved for the machine room is preferably essentially wider than the elevator hoistway in at least one lateral direction. Thus the working is safe and a conventional machine room is formed.

In a more refined embodiment of the concept according to the invention, which embodiment is preferably according to one or more of the embodiments presented in the preceding, the platform is lifted with a hoisting device, which takes the vertical support force needed for lifting from a structure of the space reserved for the machine room, preferably such that the support force can be taken from higher than the level of the top surface of the floor of the space (M) reserved for the machine room, preferably from the roof and/or walls of the space reserved for the machine room and/or from an additional support structure arranged in the space reserved for the machine room, which additional support structure is preferably supported on the floor. Thus the support structure of the platform can be brought into its position in the space M by pulling from above. The advantage of pulling is the simplicity of the lifting. When the support point of the lifting is above, higher than the floor level of the space M, sufficient pulling upwards is easy. By lifting this way, the machinery supported by the support structure comprised in the platform can at the same time be lifted into the space M reserved for the final machine room. Nevertheless, the machinery does not necessarily need to be lifted at the same time.

In a more refined embodiment of the concept according to the invention, which embodiment is preferably according to one or more of the embodiments presented in the preceding, the casting forms a level, the top surface of which is on essentially the same level as the top surface of the floor of the machine room. In this way a safe (e.g. the danger of tripping is eliminated) and aesthetic structure is formed, when the casting and the floor together form a level.

In a more refined embodiment of the concept according to the invention, which embodiment is preferably according to one or more of the embodiments presented in the preceding, the aforementioned load-bearing structure is a part of the floor of the space reserved for the final machine room or an additional support structure supported on the floor or a wall structure of the top part of the elevator hoistway. The floor is a simple and supportive support point for supporting the support structure directly or indirectly via an additional support structure. A wall structure of the top part of the elevator hoistway, on the other hand, enables simple supporting below the top surface of the floor.

In a more refined embodiment of the concept according to the invention, which embodiment is preferably according to one or more of the embodiments presented in the preceding, the points (surfaces B) of the aforementioned load-bearing structures, resting on which the support structure is supported are level with the top surface of the floor of the space reserved for the final machine room or above said top surface. One advantage, among others, is that the support structure is more isolated from the building with respect to vibration. Likewise it is simple to perform the casting under the support structure and to form a conventional machine room in which metal support structures are above the floor level.

In a more refined embodiment of the concept according to the invention, which embodiment is preferably according to one or more of the embodiments presented in the preceding, the points (surfaces B) of the aforementioned load-bearing structures, resting on which the support structure is supported are below the top surface of the floor of the space (M) reserved for the machine room. One advantage is the low space consumption of the machine room and the low quantity of parts rising from the floor level (aesthetic appeal, reduced risk of tripping).

In a more refined embodiment of the concept according to the invention, which embodiment is preferably according to one or more of the embodiments presented in the preceding, the casting and the floor of the space reserved for the final machine room form an essentially uniform flat top surface. Waterproofness, safety and sound insulation, inter alia, improve.

In a more refined embodiment of the concept according to the invention, which embodiment is preferably according to one or more of the embodiments presented in the preceding, the casting (C) forms at least partially the roof structure of the final elevator hoistway. One advantage is that the structure is safe and a conventional machine room that is observed to be good is achieved despite the exceptional method.

In a more refined embodiment of the concept according to the invention, which embodiment is preferably according to one or more of the embodiments presented in the preceding, in the casting the free spaces or apertures (which sort of extend through from the platform) connecting the space above the support structure and the space below the support structure below the machinery at the point of the elevator hoistway are filled with casting material. In this way vertical space usage is efficient. Little casting material is used.

In a more refined embodiment of the concept according to the invention, which embodiment is preferably according to one or more of the embodiments presented in the preceding, before the machinery of the elevator is transferred into the space that is an extension of the elevator hoistway and is reserved for the final machine room by lifting the platform that supports the machinery, the working platform that is above the machinery is removed from being in connection with the platform that supports the machinery. In this case, one advantage is the lightening and simplification of the next lift and easier usage of the space. Particularly advantageous in this case is that the platform is lifted with a hoisting device that takes the vertical support force needed for lifting from a structure of the space reserved for the machine room with one of the methods mentioned in the application. Likewise, in this way with the arrangement the structure 18 can be lifted sufficiently high.

In a more refined embodiment of the concept according to the invention, which embodiment is preferably according to one or more of the embodiments presented in the preceding, before the machinery of the elevator is transferred into the space that is an extension of the elevator hoistway and is reserved for the final machine room by lifting the platform that supports the machinery, a part of the frame of the platform that supports the machinery, preferably at least those parts of the frame of the platform that supports the machinery that are above the machinery, preferably such that the total height of the platform that supports the machinery essentially decreases, is removed from being in connection with the platform that supports the machinery. In this case, one advantage is the lightening and simplification of the next lift and easier usage of the space. Particularly advantageous in this case is that the platform is lifted with a hoisting device that takes the vertical support force needed for lifting from a structure of the space reserved for the machine room with one of the methods mentioned in the application. Likewise, in this way with the arrangement the structure 18 can be lifted sufficiently high.

In a more refined embodiment of the concept according to the invention, which embodiment is preferably according to one or more of the embodiments presented in the preceding, before the machinery of the elevator is transferred into the space that is an extension of the elevator hoistway and is reserved for the final machine room by lifting the platform that supports the machinery, some parts are removed from being in connection with the platform that supports the machinery, preferably at least one or more of the following:

- at least a part, preferably all, of the hoisting means, which are arranged to lift the platform while it is being supported by the support structure upwards in the elevator hoistway in connection with jump-lifts, preferably at least the hoisting device,
- a part of the frame of the platform that supports the machinery, preferably at least those parts of the frame of the platform that supports the machinery that are above the machinery, preferably such that the total height of the platform that supports the machinery essentially decreases,
- the working platform above the machinery,
- the buffers, the support structure, supported on which the platform that supports the machinery is moved upwards in the elevator hoistway in connection with jump-lifts, The advantage of disassembly is that the volume (e.g. height) decreases and the structure becomes lighter. In this case the lifting into the machine room becomes easier from the viewpoint of the hoisting capacity and space requirement. Particularly advantageous in this case is that the platform is lifted with a hoisting device that takes the vertical support force needed for lifting from a structure of the space reserved for the machine room with one of the methods mentioned in the application. Likewise, in this way with the arrangement the structure 18 can be lifted sufficiently high. The whole method is simplified and the hoisting device to be used can be the same with which the installation platform 15 was moved in the earlier phases.

In a more refined embodiment of the concept according to the invention, which embodiment is preferably according to one or more of the embodiments presented in the preceding, after each aforementioned jump-lift the platform that supports the machinery is supported in its position in the elevator hoistway supported by the support structure of the platform that supports the machinery, which support structure extends to rest on the top surface of a load-bearing structure of the building on at least two opposite sides of the elevator hoistway. Thus the same strong support structure can be used for a number of needs (for forming the final support structure and as a platform supporter) without substantial modifications to the support structure.

In a more refined embodiment of the concept according to the invention, which embodiment is preferably according to one or more of the embodiments presented in the preceding, after each aforementioned jump-lift the platform that supports the machinery is supported in its position in the elevator hoistway and between consecutive lifts the machinery that is on the platform is used to move the elevator car below the platform for serving passengers of the building. An advantage is that an effective jump-lift is achieved.

In a more refined embodiment of the concept according to the invention, which embodiment is preferably according to one or more of the embodiments presented in the preceding, the support structure comprises a support means that is movable in the lateral direction of the support structure between a contracted and an extended position on at least two sides of the support structure, which two sides are opposite to each other. One advantage is the efficiency, reliability and suitability to the method owing to the good adaptability of the structure.

In a more refined embodiment of the concept according to the invention, which embodiment is preferably according to one or more of the embodiments presented in the preceding, that when the structures of the platform (4) are converted into the final load-bearing structure of the machinery, at least a part of the movable support means of the support structure are permanently locked into the extended position, e.g. by welding or bolting them to be immovable in relation to the support structure. One advantage is an improvement in the reliability and the safety of the structure.

In a more refined embodiment of the concept according to the invention, which embodiment is preferably according to one or more of the embodiments presented in the preceding, in the method the machinery that has been in use between jump-lifts is used as the final machinery of the elevator for moving the elevator car of the final elevator. One advantage is the minimal need to replace parts and a faster conversion phase, and essentially the same machinery structure from the start to the end of the method, which structure does not need altering in between.

In a more refined embodiment of the concept according to the invention, which embodiment is preferably according to one or more of the embodiments presented in the preceding, the aforementioned machinery preferably forms an entity, which comprises at least an electric motor and preferably also a traction sheave, and preferably in addition also a drive of the electric motor.

In a more refined embodiment of the concept according to the invention, which embodiment is preferably according to one or more of the embodiments presented in the preceding, the machinery is supported on a support structure via vibration damping, which vibration damping preferably comprises dampers placed between the support structure (18) and the frame of the machinery, preferably at least passive dampers such as e.g. rubber dampers. The supporting is according to this both during jump-lifts and in the final elevator. One advantage is a noise-free and supportive structure from the start to the end of the method, which structure does not need altering in between.

In a more refined embodiment of the concept according to the invention the space reserved for the machine room is a space that is enclosed at the top being bounded by a roof.

In a more refined embodiment of the concept according to the invention the space reserved for the machine room is a space with a floor.

In a more refined embodiment of the concept according to the invention, which embodiment is preferably according to one or more of the embodiments presented in the preceding, in jump-lifts the platform 4 is lifted while being supported by the structure 6 upwards in the elevator hoistway 1, which structure 6 can be supported on the wall structures of the elevator hoistway and can be moved, and the lift is performed with a hoisting means (9,10) arranged to act between the structure 6 and the platform 4, which structure 6 is preferably above the platform 4. One advantage is also that a worksite crane of the building is not needed for this so-called climbing jump-lift method either, and the method can be performed essentially fully without a worksite crane of the building. Thus also essentially the entire method can be performed with the same means.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. Each embodiment can also singly and separately from the other embodiments form a separate invention.

LIST OF FIGURES

In the following, the invention will be described in detail by the aid of some examples of its embodiments with reference to the attached drawings, wherein FIG. 1 presents a diagrammatic side view of one preferred construction-time elevator arrangement of an elevator in a building, with which arrangement jump-lifts can be performed.

Figure 2:
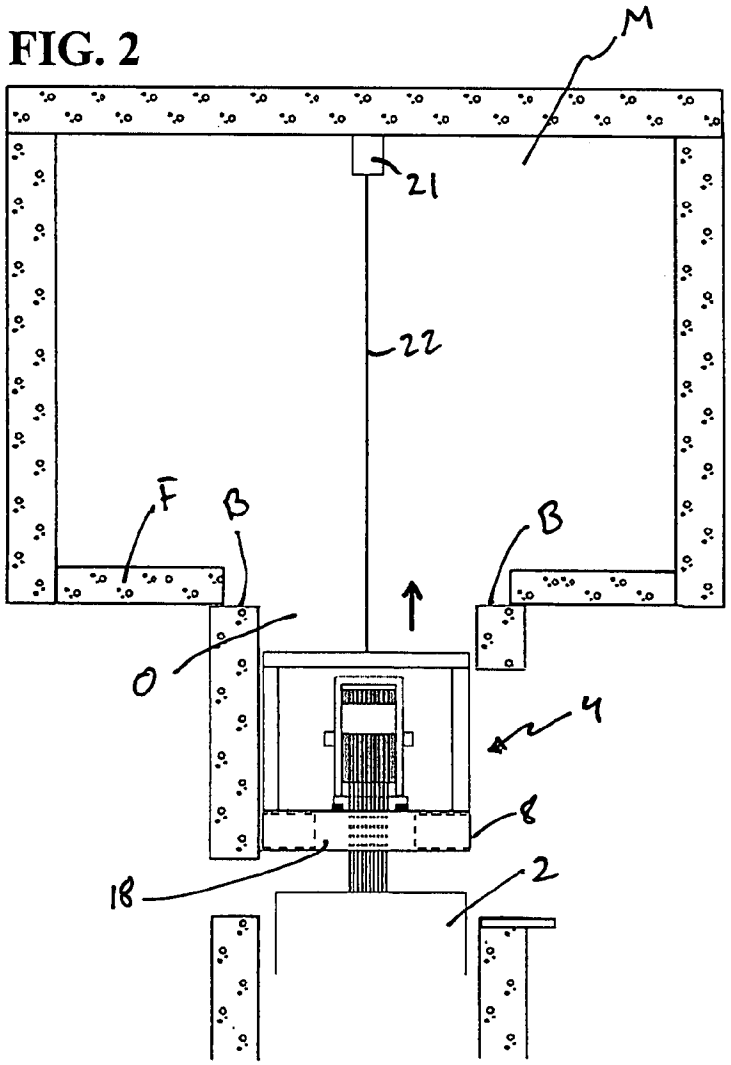

FIG. 2 presents a situation in which the machinery is being lifted according to the invention into the space reserved for the final machine room.

Figure 3:
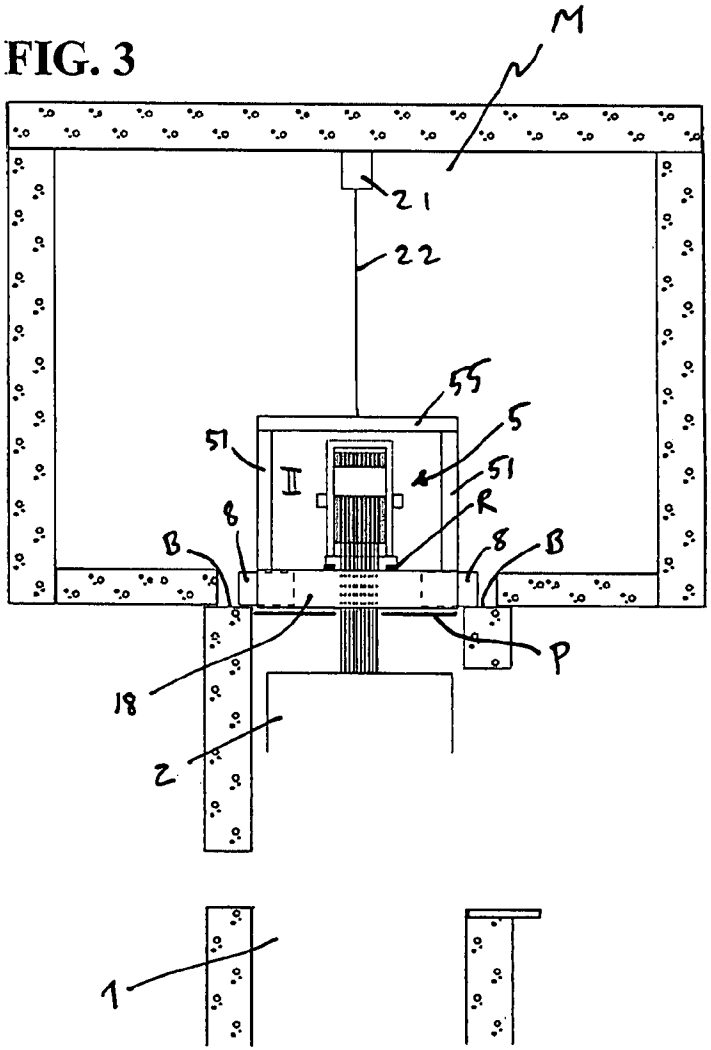

FIG. 3 presents a situation in which the machinery is in the space reserved for the final machine room.

Figure 4:
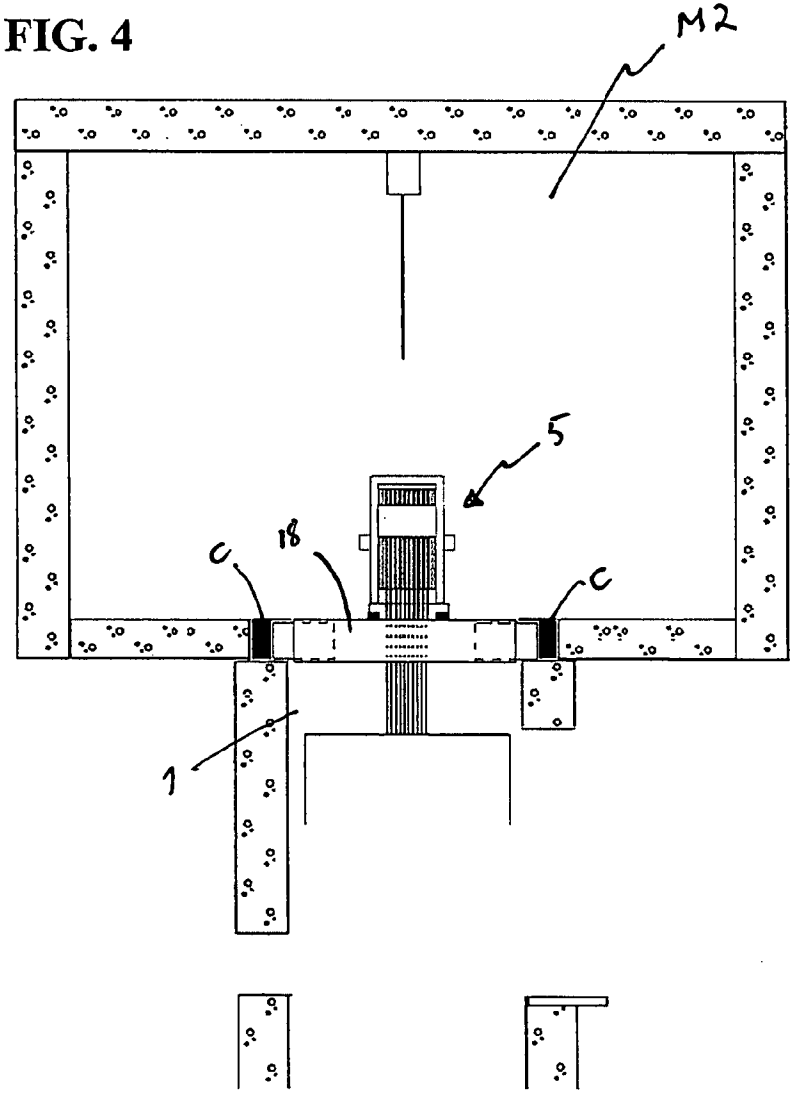

FIG. 4 presents a final machine room, in which the machinery is being supported by the structure that supports the machinery (5) of the final machine room (M2).

Figure 5:
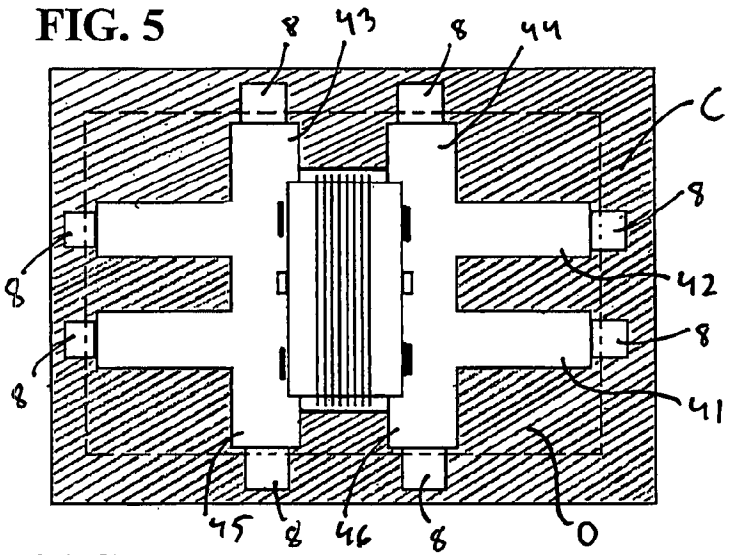

FIG. 5 presents a top view of the position of the support structure in the space reserved for the final machine room when the method has been implemented according to FIGS. 2-4

Figure 6:
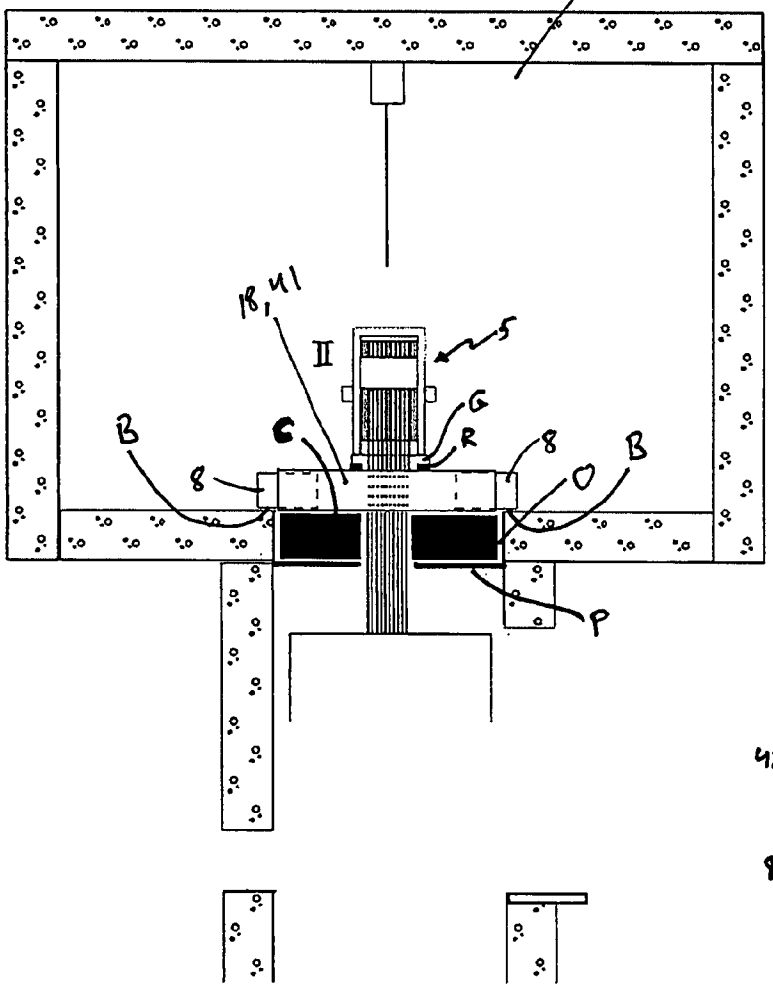

FIG. 6 presents a final machine room, in which the machinery is being supported by the structure that supports the machinery (5) of the final machine room (M2).

Figure 7:
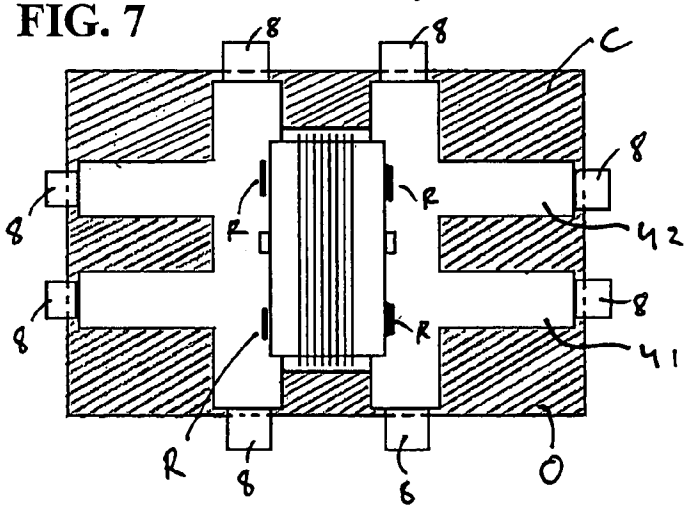

FIG. 7 presents a top view of the position of the support structure according to the embodiment of FIG. 6 in the space reserved for the final machine room.

Figure 8:
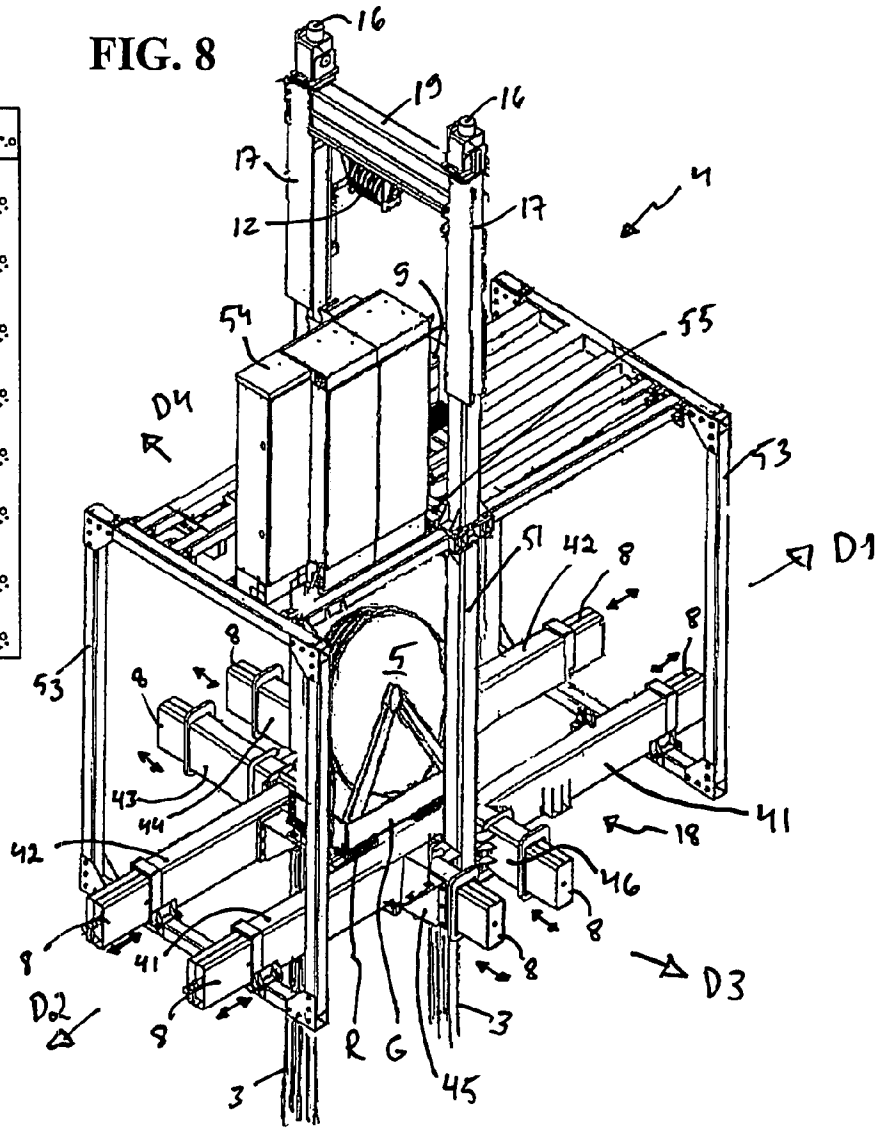

FIG. 8 presents a preferred structure of the platform that supports the machinery.

DETAILED DESCRIPTION OF THE INVENTION

The arrangement according to FIG. 1 for enabling jump-lifts comprises a platform 4 that supports the machinery 5 fitted into an elevator hoistway 1, which platform supports the elevator car 2 below it via hoisting roping 3. When the construction of the elevator hoistway has progressed to a sufficient stage of completion, a jump-lift can be performed utilizing the arrangement for changing the range of movement of the elevator car 2 in steps so that it reaches to higher in the elevator hoistway 1. This is arranged to be performed by lifting the supporting platform upwards in the elevator hoistway 1. For this purpose the arrangement comprises a movable support structure 6 supported on the wall structures of the elevator hoistway above the supporting platform 4, as well as hoisting means (9,10) arranged to act between the structure 6 and the platform 4, which hoisting means are arranged to lift the supporting platform 4 while it is being supported by the structure 6 upwards in the elevator hoistway 1. The structure 6 is supported on the wall structures 20 of the elevator hoistway 1 for taking the vertical support force needed for lifting the platform 4 from the building, more particularly from its load-bearing concrete frame parts. FIG. 1 presents a situation in which the supporting platform 4 of the elevator car 2 has just been lifted upwards in the elevator hoistway 1 and the elevator car 2 is taken into use to serve passengers in the lower floors of the building. In FIG. 1 the platform 4 and the support structure are each in position in the elevator hoistway 1 in a so-called lower disposed position I with respect to the later installation phases, and the platform 4 is used for supporting the machinery 5 and the machinery 5 is used for moving the elevator car.

The elevator arrangement comprises a second support structure 14 in the elevator hoistway above the support structure 6, and second hoisting means for lifting the support structure 6 in the elevator hoistway while it is being supported on the second structure 14. The second hoisting means comprise a second hoisting device 21, which is preferably arranged to lift the support structure and/or an installation platform by means of a rope 22 with the lifting ratio of 1:1 or 2:1. The second hoisting means can also be arranged to move a working platform 15 in the elevator hoistway 1 that is under construction in the part of the elevator hoistway 1 between the structure 14 and the structure 6.

When it is desired to perform the next jump-lift, the structure 6 is lifted upwards in the elevator hoistway with the second hoisting means 21 that are connected to the structure. The amount of rope 10 needed in this case is released from the reel 23. For the purpose of a jump-lift, the platform 4 is suspended from the structure 6 via at least one hoisting device 9 and rope 10 comprised in the hoisting means, and the platform 4 is hoisted upwards in the elevator hoistway with a lifting ratio of 1:x, where x is greater than 1. In other words, the platform 4 that is at other times supported on the building is moved to be supported by the hoisting means and lifted. X is preferably some value between 4-12, preferably 6, 7, 8, 9 or 10, even more preferably 6, 8 or 10, most preferably of all 8. In the method the vertical support force needed for lifting is taken from the building by means of the structure 6 that is supported on the wall structures of the elevator hoistway.

After each jump-lift the platform 4 supporting the machinery 5 is supported in its position in the elevator hoistway supported by the support structure 18 of the platform that supports the machinery, which support structure extends to rest on the top surface of a load-bearing structure of the building on at least two opposite sides of the elevator hoistway. For this purpose the platform 4 comprises support means 8. For this purpose also the wall 20 can preferably comprise pockets that open towards the elevator hoistway extending inside the vertical projection of the wall, or alternatively load-bearing beams.

The platform that supports the machinery comprises at least an upper beam 19 and a lower beam 7, which are rigidly fixed in relation to each other and which enable the lifting of the entire supporting platform 4 at one time as a unit with the apparatuses (e.g. the machinery 5 for moving the car 3) inside it. The elevator hoistway 1 is formed inside the building and is vertical and can comprise e.g. concrete walls 20. The guide rails (not shown) of the elevator car in the part of the elevator hoistway 1 below the supporting platform 4 are already fixed to the walls of the elevator hoistway. Above the structure, where the elevator hoistway is unfinished, the work to install the car guide rails can be performed from a working platform 15. With the method, the elevator under construction will come to form the final elevator of the building after the building is completed.

According to the invention when the platform 4 has been lifted with jump-lifts to the top parts of the elevator hoistway, preparations are made for lifting the platform 4 into the space reserved for the final machine room. In this case some parts, preferably at least one or more of the following, are removed from being in connection with the platform 4 that supports the machinery:

- at least a part, preferably all, of the hoisting means (9,10), which are arranged to lift the supporting platform (4) while it is being supported by the support structure (6) upwards in the elevator hoistway (1) in connection with jump-lifts, preferably at least the hoisting device (9),
- a part (16,17,19,52-54) of the structure of the platform that supports the machinery, preferably at least those parts of the frame of the platform that supports the machinery that are above the machinery, preferably such that the total height of the platform that supports the machinery essentially decreases,
- the working platform (52) above the machinery,
- the buffer (16)
- a structure (6), supported on which the platform that supports the machinery is moved upwards in the elevator hoistway in connection with jump-lifts, These parts can be removed from being in connection with the platform 4 e.g. via the landing apertures. In this case the structure of the platform becomes lighter and smaller for the next phases of the method. At least the support structure 18, to which the machinery 5 is fixed, is left and not disassembled from the platform. The removal of the parts is not however necessary.

Next the platform 4, which thus in this phase comprises at least a support structure 18, is suspended from a hoisting device 21 that is higher than the platform for lifting the platform 4 e.g. in the manner presented by FIG. 2 by pulling it upwards so far that the machinery 5 of the elevator moves into the space M that is an extension of the elevator hoistway and is reserved for the final machine room of the elevator. The machinery 5 and the support structure 18 are thus transferred to position II that is higher in the vertical direction. When the machinery 5 has been transferred into the space M, the platform 4 that supports the machinery 5 is supported in its position, and the structure that supports the machinery of the final machine room of the elevator is formed at least partly from the aforementioned platform 4, more particularly its support structure 18 that supports the machinery, which support structure 18 has supported the machinery 5 and the platform 4 in the elevator hoistway already during jump-lifts.

The lifting of the machinery is performed by lifting it while it is being supported by the support structure 18 comprised in the platform 4 into the space (M) reserved for the final machine room by lifting the support structure (18) through from the aperture (O) leading into the space (M) that is an extension of the elevator hoistway (1) and is reserved for the final machine room, after which the support structure (18) is lowered to rest on the load-bearing structures of the building in the position presented by FIG. 3 (or 6). These load-bearing structures can be e.g. the floor of the machine room or a recess of the floor of the machine room or a support element supported on the floor or on a recess.

The lifting of the platform 4 that supports the machinery 5 is advantageous to perform with a hoisting device 21, which takes the vertical support force needed for lifting from a structure of the space (M) reserved for the machine room, preferably such that the support force can be taken from higher than the level of the top surface of the floor of the space (M) reserved for the machine room. This structure is in the figures a roof structure of the space (M) reserved for the final machine room, but other preferred alternatives are the walls and/or an additional support structure arranged in the space (M) reserved for the final machine room, which additional support structure is preferably supported on the floor F. In this way a sufficiently reliable lifting point that will bear the load to be moved can be guaranteed. Likewise, in this way with the arrangement the structure 18 can be lifted sufficiently high. By means of the aforementioned additional support structure the point of support can be raised above the floor level of the machine room.

The structure (F,C,B,18 in the figures) that supports the machinery of the final machine room M2 of the elevator is formed at least partly from the support structure (18) of the aforementioned platform that supports the machinery such that the space above (and possibly also reaching to the sides of) the support structure 18 forms the space of the final machine room M2 and the space below the support structure 18 forms the final elevator hoistway.

To facilitate the supporting of the support structure 18 on the load-bearing structure B, the support structure 18 can be transferred between a contracted and an extended position, and that the machinery 5 is lifted while being supported by the platform 4 into the space M by lifting the support structure 18 through from the aperture (O) leading into the space (M) such that the support structure is in the contracted position, after which the support structure is transferred to the extended position, in which position the support structure (18) extends to over the load-bearing structures, and the support structure is lowered to rest on the aforementioned load-bearing structures. With this arrangement it is easy to fit the support structure through from the aperture O. The support structure extends in the extended position to over a load-bearing structure B of the machine room on at least two opposite sides of the aperture, in which case the supporting can be quickly and simply formed to be reliable.

After the support structure has been lowered to rest on the aforementioned load-bearing structures, casting is performed, in which casting the aperture/apertures between the elevator hoistway and the space M are filled with casting material (C), such as with e.g. concrete-based casting material. A plate P is used for the casting, which plate is placed horizontally below the top surface of the floor F of the space M at the point of the elevator hoistway and the casting material is poured onto the plate and said material is allowed to harden. This is advantageous to perform such that the casting C forms a level, the top surface of which is on essentially the same level as the floor surface of the machine room. This is advantageous to perform such that the casting and the floor of the machine room form an essentially uniform flat top surface, such that no vertical gaps remain between them, which improves the integration, safety, strength, sound insulation, waterproofness and aesthetics of the structures.

In the embodiment presented by FIGS. 2-5, the points (surfaces B) of the aforementioned load-bearing structures, onto which the support structure 18 is lowered to rest, are below the top surface of the floor F of the space M.

As presented with dashed lines in FIG. 5, in the casting the free spaces/apertures connecting the space reserved for the machine room are filled with casting material C. As presented, in the casting the free spaces or apertures, which sort of extend through from the support structure 18, connecting the space above and the space below the support structure 18 below the machinery at the point of the elevator hoistway are filled with casting material. The casting is made to extend to support the beams of the support structure 18 at their sides such that the beams are embedded in the casting. Also the spaces between the support structure and the floor structures of the machine room space on the sides of the support structure are filled with casting material in the manner presented by FIGS. 4 and 5.

FIGS. 6 and 7 present a second embodiment, which otherwise corresponds to that presented in FIGS. 2-5, but the points (surfaces B) of the aforementioned load-bearing structures, onto which the support structure is lowered and supported are level with the top surface of the floor of the machine room and the aforementioned load-bearing structure is a part of the floor of the machine room. Alternatively, between the support structure 18 and the load-bearing structure could be a support structure, such as a beam, plate or insulating part (e.g. a rubber support), via which the support force is transferred from the floor to the support structure. A difference is also that because the support structure is essentially in its entirety above the top surface of the floor, the casting is performed such that at least most of the casting is below the support structure.

FIG. 8 presents a preferred structure of the platform 4 that supports the machinery 5, which structure is suited for use in the methods according to the embodiments described in the preceding, and also otherwise in elevators that utilize jump-lifts. The platform 4 comprises a support structure 18, which comprises a plurality of beams (41-46) that are fixed to each other, which beams are arranged such that towards the four lateral directions (D1,D2,D3,D4) of the platform points at least one beam (preferably two beams in the manner presented). Each beam comprises at its end that points in a lateral direction a support element 8 that is moved in relation to the support structure 18, supported by which support element the support structure can be lowered. The beams mentioned, which point towards the four lateral directions (D1-D4) of the platform are on essentially the same plane and in a horizontal position. The aforementioned plurality of beams comprises two parallel beams (41,42) that are side-by-side, each of which beams comprises an end that points towards a first lateral direction (D1) of the platform and an end that points in an opposite second lateral direction (D2) of the platform. Rigidly fixed to the aforementioned parallel beams (41,42) that are side-by-side are beams (43-46) that point towards a third lateral direction (D3) of the platform and towards a fourth lateral direction (D4) of the platform, which third and fourth lateral directions (D3,D4) are opposite to each other and at a right angle to the first and the second lateral direction (D1,D2). The aforementioned beams that are side-by-side are at a horizontal distance from each other and the beams (43-46) that are fixed to the aforementioned beams (41,42) that are side-by-side comprise two beams that point towards the third lateral direction (D3) and two beams that point towards the fourth lateral direction (D4). The aforementioned two beams (45,46) that point towards the third lateral direction (D3) are at a horizontal distance from each other and the two beams (43,44) that point towards the fourth lateral direction (D4) are at a horizontal distance from each other, and preferably such that the aforementioned two beams that point towards the third lateral direction (D3) and towards the fourth lateral direction (D4) point in a matching and parallel manner. The support structure can be supported e.g. such that a beam or a support means 8 at the end of a beam is supported in a pocket of the wall of the elevator hoistway or on top of a beam of the elevator hoistway. The platform 4 and/or its support structure 18 that are presented by FIG. 8 can form per se a separate invention. The machinery 5 is supported on a support structure 18 via vibration damping R, which vibration damping preferably comprises dampers placed between the support structure and the frame of the machinery, preferably at least passive dampers such as e.g. rubber dampers. The machinery 5 can be placed to be supported by the support structure in a different attitude than that shown in FIG. 8. In the method preferably the buffer 16, vertical beam 17, horizontal beam 19, working platform 52, vertical beam 53 and cubicles 54 are removed from the platform structures 4 as described in the preceding. Preferably the hoist 9 and the diverting pulleys 12 are also removed. In the method the structure supporting the machinery of the final machine room of the elevator is formed from the support structure 18, said structure being thus the same that was already earlier used for supporting the machinery 5 in connection with jump-lifts. The machinery 5 preferably forms an entity, which comprises an electric motor and a traction sheave, and preferably further also a drive of the electric motor.

It is obvious to the person skilled in the art that the invention is not limited to the embodiments described above, in which the invention is described using examples, but that many adaptations and different embodiments of the invention are possible within the frameworks of the inventive concept defined by the claims presented below. It is therefore obvious, e.g. that during a jump-lift the elevator car can be lifted along with the platform that supports the machinery, or it can be locked in the elevator hoistway. It is also obvious that the casting that is presented is not necessary.

The invention claimed is:

1. A method for installation of an elevator, the method comprising:

moving, without use of a worksite crane, a first platform of the elevator and a separate first support structure by a plurality of jump-lifts in progressive steps upwards in an elevator hoistway, the first platform including at least machinery for moving an elevator car during the installation of the elevator; and utilizing at least a movable support structure of the first platform to form a final support structure supporting the machinery in a final machine room of the elevator after completion of a final jump-lift among the plurality of jump-lifts, wherein the first platform is positioned below the separate first support structure in the elevator hoistway, the separate first support structure supports the first platform during the installation of the elevator, the separate first support structure is positioned below a separate second support structure in the elevator hoistway, and the separate second support structure supports the separate first support structure via a hoisting device and a rope or cable during the installation of the elevator.

2. The method according to claim 1, further comprising:

transferring, via the final jump-lift, the machinery from a position in the elevator hoistway into a space reserved for the final machine room.

3. The method according to claim 2, wherein the transferring comprises:

lifting the movable support structure through an aperture leading into the space reserved for the final machine room; and lowering the movable support structure onto load-bearing structures of a building.

4. The method according to claim 3, wherein the load-bearing structures include at least one of, a part of a floor of the space reserved for the final machine room, a third support structure supported on the floor, or a wall structure of a top part of the elevator hoistway.

5. The method according to claim 3, further comprising:

removing, prior to the lifting of the movable support structure, at least one of at least a part of the hoisting device, at least a part of a frame of the first platform supporting the machinery, a working platform above the machinery, buffers, or the separate first support structure.

6. The method according to claim 2, after transferring the machinery into the space reserved for the final machine room, the method further includes supporting the first platform in position in the final machine room, wherein in the final machine room, the machinery is at least partly supported by the movable support structure.

7. The method according to claim 2, wherein:

the space reserved for the final machine room includes a floor; and the space reserved for the final machine room is wider than the elevator hoistway in at least one lateral direction.

8. The method according to claim 1, further comprising:

transferring, while being supported by the first platform, the machinery into a space reserved for the final machine room of the elevator by lifting the movable support structure through an aperture leading into the space while the movable support structure is in a contracted position;

extending the movable support structure into an extended position in which the movable support structure extends over load-bearing structures of a building; and lowering the movable support structure onto the load-bearing structures of the building.

9. The method according to claim 8, wherein after lowering the movable support structure onto the load-bearing structures of the building, the method further includes, filling the aperture between the elevator hoistway and the space with casting material.

10. The method according to claim 9, wherein the filling comprises:

casting the casting material onto a plate placed in the aperture, a top surface of the plate being below a top surface of a floor of the space reserved for the final machine room.

11. The method according to claim 9, further comprising:

casting a platform having a top surface on substantially the same level as a top surface of a floor of the final machine room.

12. The method according to claim 8, wherein, in the extended position, the movable support structure extends over a load-bearing structure of the building on at least two opposite sides of the aperture.

13. The method according to claim 1, further comprising:

lifting the separate first support structure with the hoisting device, which takes a vertical support force needed for lifting from a structure of a space reserved for the final machine room of the elevator, such that the support force is taken from a position higher than a level of a top surface of a floor of the space reserved for the final machine room.

14. The method of claim 13, wherein the vertical support force is taken from at least one of, a roof of the space reserved for the final machine room, walls of the space reserved for the final machine room, or an additional support structure arranged in the space reserved for the final machine room, the additional support structure being supported by the floor of the space reserved for the final machine room.

15. The method according to claim 1, further comprising:

utilizing the machinery to move the elevator car and serve passengers during the installation of the elevator and while the machinery is positioned lower in the elevator hoistway relative to the separate first support structure.

16. The method according to claim 1, further comprising:

serving passengers using the elevator before reaching a final lifting height of the elevator; and transferring the machinery into a space reserved for the final machine room of the elevator when the first platform reaches an upper part of the elevator hoistway, the space reserved for the final machine room of the elevator being an extension of the elevator hoistway, and being above the upper part of the elevator hoistway.

17. The method according to claim 1, wherein the utilizing comprises:

forming the final support structure supporting the machinery in the final machine room of the elevator at least partly from the movable support structure of the first platform such that a space above the movable support structure is the final machine room, and the elevator hoistway is below the movable support structure.

18. The method according to claim 1, further comprising:

supporting, after each of the plurality of jump-lifts, the first platform in position in the elevator hoistway by extending the movable support structure to rest on a top surface of a load-bearing structure of a building on at least two opposite sides of the elevator hoistway.

19. The method according to claim 1, wherein the machinery used to move the elevator car during the installation of the elevator between the plurality of jump-lifts is used as the machinery for moving the elevator car of the elevator after installation of the elevator is complete.

20. The method according to claim 9, wherein the filling comprises:

forming at least part of a roof structure of the elevator hoistway.

21. A method for installation of an elevator, the method comprising:

moving, without use of a worksite crane, a first platform of the elevator by a plurality of jump-lifts in progressive steps upwards in an elevator hoistway, the first platform including at least machinery for moving an elevator car during the installation of the elevator;

removing at least a part of a frame of the first platform, to decrease a total height of the first platform, the part of the frame of the first platform including at least a part of the frame of the first platform positioned above the machinery;

transferring, via a final jump-lift among the plurality of jump-lifts, the machinery from a position in the elevator hoistway into a space reserved for a final machine room of the elevator; and utilizing at least a support structure of the first platform to form a final support structure supporting the machinery in the final machine room after completion of the final jump-lift among the plurality of jump-lifts, the first platform having been positioned lower in the elevator hoistway relative to a separate movable support structure supporting the first platform during the installation of the elevator.

* * * * *